United States Patent [19]

Newsoroff

[11] Patent Number: 4,897,210

[45] Date of Patent: Jan. 30, 1990

[54] LITHIUM COMPLEX GREASE THICKENER AND HIGH DROPPING POINT THICKENED GREASE

[75] Inventor: George P. Newsoroff, Woodlands, Tex.

[73] Assignee: Pennzoil Products Company, Houston, Tex.

[21] Appl. No.: 217,897

[22] Filed: Jul. 12, 1988

[51] Int. Cl.[4] ..... C10M 105/38

[52] U.S. Cl. ..... 252/41; 252/38; 252/32

[58] Field of Search ..... 252/32, 38, 41

[56] References Cited

U.S. PATENT DOCUMENTS

| | | | |
|---|---|---|---|
| 3,929,651 | 12/1975 | Murray | 252/41 |
| 3,985,662 | 10/1976 | Campbell | 252/41 |
| 4,435,299 | 3/1984 | Carley | 252/41 |
| 4,582,619 | 4/1986 | Carley | 282/41 |
| 4,737,299 | 4/1988 | Grasshoff | 252/41 X |
| 4,738,797 | 4/1988 | Halpern | 252/51.5 R X |

FOREIGN PATENT DOCUMENTS

| | | | |
|---|---|---|---|
| 0145297 | 8/1984 | Japan | 252/41 |

*Primary Examiner*—William R. Dixon, Jr.
*Assistant Examiner*—James M. Hunter, Jr.
*Attorney, Agent, or Firm*—Lowe, Price, LeBlanc, Becker & Shur

[57] ABSTRACT

A lithium complex grease thickener for increasing the dropping point of a lubricating oil comprises as primary indgredients a lithium salt of 12-hydroxystearic acid or from alkyl esters thereof and a dilithium salt derived from dialky esters of terephthalic acid in a molar proportion of about 0.5 to 15:1.

A lithium complex thickened grease of high lubricating activity, shear stability, penetration, water resistance and dropping point comprises a major proportion of a lubricating oil and about 1 to 45 wt % of the lithium complex thickener of this invention with respect to the thickened grease.

20 Claims, No Drawings

LITHIUM COMPLEX GREASE THICKENER AND HIGH DROPPING POINT THICKENED GREASE

TECHNICAL FIELD

This invention relates to an improved lithium complex grease thickener containing a dilithium salt of terephthalic acid and a lithium salt of 12-hydroxystearic acid. This invention also relates to a thickened grease having a high effective dropping point imparted by the thickener of the invention as well as high lubricating activity, shear stability, penetration and water resistance.

BACKGROUND ART

Lithium greases have been known and widely used due to their advantages which include high water resistance and ease of dispersion, in all types of lubricating oil base stocks. Generally, lithium soaps used as thickening agents for lithium complex greases have been prepared by reacting lithium hydroxide or other lithium bases with conventional high molecular weight fatty acids. However, lithium 12-hydroxystearic acid and related lithium salts have been particularly preferred because of their great mechanical stability.

The fields of application for lithium complex greases having a high dropping point are extensive. By means of example, lithium complex greases have been successfully used for the lubrication of traction motor bearings, automotive disc brake wheel bearings and the like, particularly for automobiles and locomotives. In many cases the bearings are required to operate for a long period of time without maintenance at temperatures as high as 250° F. and thus require particularly high dropping point greases for smooth operation.

Lithium soap greases are known in the art which utilize lithium salts of hydroxyfatty acids and other components.

U.S. Pat. No. 3,929,621 to Murray et al. discloses a grease composition including a dilithium salt of a $C_4$–$C_{12}$ dicarboxylic acid, a lithium soap of a 9-, 10- or 12-hydroxy ($C_{12}$–$C_{24}$) fatty acid such as lithium 12-hydroxystearate, and a lithium salt formed in situ in the grease from a second hydroxycarboxylic acid.

U.S. Pat. No. 4,435,299 to Carley et al. discloses a grease composition including the lithium salt of a $C_{12}$–$C_{24}$ hydroxyfatty acid such as 12-hydroxystearic acid in a dilithium soap of a $C_4$–$C_{12}$ dicarboxylic acid.

However, none of the prior art patents utilizes aromatic dicarboxylic acids. By means of example, Murray et al. (column 2, lines 13–15) and Carley et al. (column 2, lines 66–68) disclose that suitable acids include succinic, glutaric, adipic, suberic, pimelic, azelaic, dodecanedioic and sebacic acids. These are all linear acids.

Among linear acids, the prior art has preferably utilized sebacic and azelaic acids, and more preferably azelaic acid. The processing of dioctyl sebacate precursor is difficult and produces noxious vapors, e.g., 2-ethylhexanol. Moreover, azelaic acid is not always readily available in the marketplace and therefore other products capable of substituting for it are needed.

U.S. Pat. No. 2,874,121 to Hotten describes grease compositions which are thickened by methyl soaps of esters of terephthalic acids. This prior art patent describes a series of metal salts which are useful including all monovalent metals of Groups I, II, III, and IV of the Mendeleeff Periodic Table. Lithium is mentioned as one of various metals but the preferred claimed metals are sodium and barium. Moreover, the terephthalic derivatives utilized by Hotten are either mixed monoalkylester-monometal salt terephthalate derivatives or mixed monoalkylester-monoalkylamide terephthalate derivatives. No mention is made by Hotten of dilithium salts from dialkyl terephthalates or to a potential use thereof as a thickener for lubricating oils. Nor is it mentioned in the Hotten patent that terephthalate acid derivatives are to be added to a lithium 12-hydroxystearate compound for thickening greases.

Accordingly, there is a specific need for an improved grease thickener which when added to at lubricating oil base stock not only affords good mechanical stability, water resistance and lubricating capacity, but in addition imparts to a lubricating oil stock to which it is added a high dropping point which enables its performance at particularly high temperatures for prolonged periods of time.

DISCLOSURE OF INVENTION

This invention relates to a grease thickener for increasing the dropping point of a lubricating oil which comprises as primary ingredients a lithium salt of a first compound selected from the group consisting of 12-hydroxystearic acid and ($C_1$–$C_{24}$) alkyl esters thereof; and a dilithium salt of a second compound selected from the group consisting of di-($C_1$–$C_{24}$) alkyl esters of terephthalic acid; the lithium salts of said first and second compounds being present in a molar proportion of about 0.5 to 15:1.

This invention also relates to a lithium complex thickened grease of high lubricating activity, shear stability, water resistance, penetration and dropping point, which comprises a major proportion of a lubricating oil; and about 1 to 45 wt % of a lithium complex grease thickener comprising as primary ingredients a lithium salt of a first compound selected from the group consisting of 12-hydroxystearic acid and ($C_1$–$C_{24}$) alkyl esters thereof, and a dilithium salt of a second compound selected from the group consisting of di($C_1$–$C_{24}$) alkyl esters of terephthalic acid, the lithium salts of said first and second compounds being present in a molar proportion of about 0.5 to 15:1.

A more complete appreciation of the invention and many of the attendant advantages thereof will be readily perceived as the same becomes better understood by reference to the following detailed description. In addition, other objects, advantages and features of the present invention will also become apparent to those skilled in the art from the following discussion.

BEST MODE FOR CARRYING OUT THE INVENTION

In accordance with the present invention there is provided a lithium complex grease thickener which increases the dropping point of a lubricating grease as it preserves the shear stability, penetration and water resistance of a lithium complex thickened grease to which it is added.

The lithium complex grease thickener of the invention has as its primary ingredients a lithium salt of 12-hydroxystearic acid or from ($C_1$–$C_{24}$) alkyl esters thereof and a dilithium salt from di($C_1$–$C_{24}$) alkyl esters of terephthalic acid in a molar proportion of about 0.5 to 15:1, preferably about 1–10:1, and still more preferably about 2–6:1. The composition may contain lithium salts from more than one stearic acid and terephthalic acid ester derivatives.

The addition of the dilithium salt from, or derived from, the dialkyl esters of terephthalic acid in the amounts described herein has proven to be effective for elevating the dropping point of greases thickened with lithium salts from 12-hydroxystearic acid or esters thereof.

The resulting properties of the thickened greases of this invention are similar in character to those obtained with more conventional precursors such as azelaic acid and dioctyl sebacate. This is an unexpected effect since dilithium terephthalates have never been used before for increasing the effective dropping point of a lubricating grease which must perform at high temperatures for prolonged periods of time. More particularly, dilithium terephthalates have never been used before in combination with other lithium salts such as the lithium salt of 12-hydroxystearic acid.

The dilithium salts of terephthalic acid may be prepared in accordance with this invention from various esters of terephthalic acid and lithium bases. Esters of terephthalic acid which can be used in the preparation of the lithium salts of the invention encompass ($C_1$–$C_{24}$) dialkyl esters of terephthalic acid. By means of example the dialkyl esters of terephthalic acid may be selected from the group consisting of dimethyl terephthalate, diethyl terephthalate, dipropyl terephthalate, dibutyl terephthalate, di(tert-butyl) terephthalate, dipentyl terephthalate, di(2,2-dimethyl propane) terephthalate, di(-methylbutyl) terephthalate, di(n-hexyl) terephthalate, diisohexyl terephthalate, di(2,3-dimethylbutyl) terephthalate, diheptyl terephthalate, dioctyl terephthalate, di(2-ethylhexyl) terephthalate, dinonyl terephthalate, didecyl terephthalate, didodecyl terephthalate, ditetradecyl terephthalate, dihexadecyl terephthalate, dioctadecyl terephthalate, dieicosyl terephthalate, didocosyl terephthalate and mixtures thereof. Also suitable are mixed esters of terephthalic acid such as methyl ethyl terephthalate, methyl propyl terephthalate, ethyl decyl terephthalate, methyl dodecyl terephthalate, propyl tetradecyl terephthalate, butyl tetradecyl terephthalate, butyl hexadecyl terephthalate, butyl octadecyl terephthalate, butyl eicosyl terephthalate, decyl tetradecyl terephthalate and mixtures thereof.

This invention utilizes dialkyl esters of an aromatic dicarboxylic acid for lithium complex formation. Of the three possible benzene dicarboxylic acid diesters, phthalic acid (the ortho substituted acid) and isophthalic acid (the meta substituted acid) diesters produce lithium complex thickeners of inferior quality when compared with those obtained with terephthalic acid diesters (the para substituted acids). The products obtained from phthalic acid and isophthalic acid diesters fail to produce homogeneous mixtures with lithium 12-hydroxystearate.

Because of the high melting point of terephthalic acid, diesters are used herein as precursors for the lithium salts. In fact, the free acids are not suitable for use in the present invention because when the thickened greases are prepared with the acids, the neutralization with lithium hydroxide produces a heterogeneous and non-reproducible product. Dialkyl esters of terephthalic acid suitable for use with this invention are ($C_1$–$C_{24}$) alkyl esters of terephthalic acid, and more preferably ($C_1$–$C_{12}$) alkyl esters thereof.

The novel lithium complex thickeners of this invention when added to lubricating oils afford the thus produced thickened greases characteristics that are comparable to those attained by other products used in the art such as dioctyl sebacate and azelaic acid but at a minimum cost. Thus, the lithium complex grease thickeners of this invention can be productively utilized as a substitute for prior art lithium complex grease thickeners which are more costly to produce and utilize components that are expensive and/or scarce.

The lithium salts of 12-hydroxystearic acid or ($C_1$–$C_{24}$) alkyl esters thereof may be formed from the free 12-hydroxystearic acid or lower alcohol esters thereof. By means of example, the lower alcohol ester of 12-hydroxystearic acid may be a ($C_1$–$C_{24}$) alkyl ester of 12-hydroxystearic acid, preferably ($C_1$–$C_{12}$) alkyl esters, and still more preferably methyl, ethyl, propyl, isopropyl and sec-butyl esters of 12-hydroxystearic acid. However, other alkyl esters thereof may also be utilized. The lithium salts of 12-hydroxystearic acid or esters thereof are obtained by reacting the corresponding acid or ester thereof with a lithium base as is known in the art.

Lithium bases suitable for use herein are known in the art. Although preferred is lithium hydroxide other lithium salts may also be utilized.

The lubricating oil base used in preparing the lithium complex thickened grease of the invention can be any of the conventionally used mineral oils, synthetic hydrocarbon oils, synthetic ester oils and the like. The lubricating oils generally have a viscosity within the range of about 35 to 200 SUS at 210° F.

Examples of synthetic lubricating oils which can be used in this invention include esters of dibasic acids such as di-2-ethylhexylsebacate, esters of glycol such as the $C_{13}$ oxo acid diester of tetraethylene glycol or complex esters, e.g., those which are formed by reacting sebacic acid with tetraethylene glycol and 2-ethylhexanoic acid. Other synthetic oils which can be used with this invention are synthetic hydrocarbons such as alkylbenzenes, e.g., alkylate bottoms from the alkylation of benzene with tetrapropylene or copolymers of ethylene and propylene. Still other oils which can be used with the present invention are silicone oils such as methylphenylpolysiloxanes and the like, polyglycol oils such as those obtained from the condensation of butyl alcohol with propylene oxide, carbonate esters such as those resulting from reacting $C_8$ oxo alcohol with ethyl carbonate to form a half ester and then reacting it with tetraethyleneglycol, and the like. Other suitable synthetic oils are polyphenyl ethers having about 3–7 ether linkages and about 4 to 8 phenyl groups.

The greases of this invention can be prepared by a variety of methods. One which is convenient is the coneutralization of 12-hydroxystearic acid or esters thereof and the diester of terephthalic acid with lithium hydroxide in the presence of at least a portion of the lubricating oil. The lithium base is added preferably in an about molar proportion to the sum of the amounts of the 12-hydroxystearic acid or esters thereof and the esters of terephthalic acid.

This neutralization can be conducted at a temperature where the ester salts dissolve in the oil. Typical temperatures are about 180° to 220° F. as is known in the art. Thereafter, the temperature is increased to about 350° to 420° F., preferably about 370° to 400° F., and the remainder of the lubricating oil is then admixed thereto to obtain the lithium complex thickened grease of this invention. The grease may be further homogenized by methods known in the art.

Other methods known in the art may also be utilized to prepare the lithium complex thickened greases of this invention.

By adding the lithium complex thickener of this invention to a lubricating oil a high performance thickened grease can be obtained which has a high dropping point, high lubricating activity, shear stability, penetration and water resistance and exhibits low wear at high temperatures, particularly temperatures higher than about 380° F., and even at temperatures higher than about 450° F.

The lithium complex thickened grease of high lubricating activity, shear stability, penetration, water resistance and dropping point provided by this invention comprises a major proportion of a lubricating oil and preferably about 1 to 45 wt % of the lithium complex thickener described above with respect to the thickened grease. More preferably, the lithium complex thickener is added in an amount of about 2 to 30 wt % with respect to the thickened grease.

In a preferred embodiment of the thickened grease the lithium salt of the 12-hydroxystearic acid or esters thereof are present in an amount of about 0.3 to 28 wt % of the grease and the dilithium salt from the dialkyl terephthalic diester is present in an amount of about 0.6 to 20 wt %, both with respect to the thickened grease.

In a still more preferred embodiment of the thickened grease of this invention the lithium salt of the 12-hydroxystearic acid or from esters thereof are present in an amount of about 2 to 20 wt %, and the dilithium salt from the dialkyl terephthalic diester is present in an amount of about 1 to 10 wt % of the thickened grease, both with respect to the grease.

The thickened grease of this invention as already indicated has a dropping point higher than about 380° F. In addition, it also has a shear stability corresponding to a softening after 10,000 strokes which is lower than 15% from its original value.

In addition to the lithium complex thickeners, the present compositions may also contain other additives recognized in the act to perform a particular function or functions.

One type of additive is an antioxidant or oxidation inhibitor. This type of additive is used primarily to extend the service life of a lubricant subjected to degradative breakdown by heat and oxygen. Typically, suitable antioxidants are organic compounds containing nitrogen, phosphorus and sulfur.

Particularly useful grease antioxidants include the following compounds:

phenyl-alpha-napthylamine,
2,2,4-trimethyldihydroquinoline oligomer,
bis (alkylphenyl) amine,
phenothiazine and
N,N-diphenyl-phenylenediamine, among others.

Another additive which may be incorporated into the grease composition is a corrosion inhibitor. Corrosion inhibitors are employed to form protective films over metal surfaces such as steel and copper and act to protect the metal against the aggressive action of water and active sulfur-containing components.

Particularly useful corrosion inhibitors include:

mercaptobenzothiazole,
barium dinonylnaphthalene sulfonate,
glycerol monooleate,
sodium nitrite, and
imidazolines of tetraethylenepentamine, among others.

Other additives which may be incorporated into the grease composition are extreme pressure-antiwear agents. These additives are used to protect sliding and rolling metal surfaces against rapid wear or premature seizure of bearing components.

Particularly useful additives imparting this property include:

antimony, lead and zinc diorganophosphorodithioates,
phosphorus-sulfide treated olefins,
sulfurized olefins,
alkylphenate sulfides and disulfides,
tricresyl phosphate,
chlorinated paraffin waxes,
sulfurized glyceryl trioleate,
antimony, lead and zinc diamyldithiocarbamate, among others.

In addition to the above, other grease additives which may be employed in the practice of this invention include fillers, tackiness agents, colorants and odor control agents, among others.

Having now generally described this invention, the same will be better understood by reference to certain specific examples, which are included herein for purposes of illustration only and are not intended to be limiting of the invention or any embodiment thereof, unless so specified.

EXAMPLES

Example 1: Preparation of Lithium Complex Thickened Grease According to the Invention with Various Diesters of Terephthalic Acid.

In all cases the base oils consist of the paraffinic oil solvent 600 neutral and 150 bright stock having a blended viscosity of 1,000 SUS at 100° F.

12-hydroxystearic acid (approximately 10 wt % of the thickened grease) and one of the terephthalate diesters listed in Table 1 below are dissolved in about one half of the oil at a temperature of 160–180° F. and neutralized with lithium hydroxide dissolved in a minimum amount of hot water.

The mixture is gradually heated to 390° F., the remainder of the lubricating oil added and mixed thoroughly. The mixture is then homogenized to produce a smooth, buttery grease.

These lithium complex thickened greases are evaluated in terms of their dropping point in the absence of any further additives. The characteristics tested are the dropping point and the shear stability of the thickened greases. The results of these tests are reported in Table 1 below.

TABLE 1

| | Terephthalate Esters Evaluated as Lithium Complex Precursors | | | | |
|---|---|---|---|---|---|
| SAMPLE | A | B | C | D | E |
| Terephthalic Esters | dimethyl | diisopropyl | di-2-ethyl hexyl | di-2-butyl | diisobutyl |
| Molar Ratio (12-hydroxystearic) acid:terephthalic ester) | 2:1 | 4:1 | 4:1 | 4:1 | 4:1 |

TABLE 1-continued

| Terephthalate Esters Evaluated as Lithium Complex Precursors | | | | | |
|---|---|---|---|---|---|
| SAMPLE | A | B | C | D | E |
| Grease Properties | | | | | |
| Penetration (60 strokes) | 219 | 262 | 295 | 298 | 262 |
| Penetration (10,000 strokes) | 239 | 287 | 330 | 316 | 282 |
| Shear Stability (% change from 60 to 10,000 strokes) | 9.1 | 9.5 | 12.0 | 6 | 7.6 |
| Dropping Point (D566) | | | | | |
| °C. | 205 | 257 | 295 | 224 | 287 |
| °F. | 401 | 495 | 560 | 435 | 549 |

In every case it is found that the dropping point of the thickened grease is above 390° F. and the shear stability of the thickened grease is within a range that makes it useful as a lubricating grease. As is known in the art greases that soften excessibly upon mechanical shearing are not useful for use with lubricating oils. Values for the shear stability corresponding to a percent of change from 60 to 10,000 strokes in the penetration test greater than 15 are undesirable. All values for the present lithium complex thickeners are below or about 12.

The lithium salt prepared from di(2-ethylhexyl) terephthalate (Sample C) is a very efficient elevator of the dropping point of a thickened grease. However, it generates 2-ethylhexanol which has a strong odor and a softening effect on the grease.

In the laboratory this by-product can be easily removed. However, for all practical purposes in a commercial production environment it is difficult to eliminate the alcohol completely because this requires holding each preparation batch at approximately 390° F. for a period of about 1–2 hours.

Esters from lower boiling point alcohols such as the dimethyl ester (Sample A) fail to produce a lithium complex. The secondary alcohol ester, di(2-butyl) ester of terephthalic acid (Sample D), only gives a modest elevation of the dropping point. However, another secondary alcohol ester, the di(isopropyl) ester of terephthalic acid (Sample B) yields a significant increase in the dropping point of the thickened grease. This is, though, a lesser increase than that obtained by using the 2-ethylhexyl ester of stearic acid (Sample C).

The primary alcohol ester diisobutyl ester of terephthalic acid (Sample E) works sufficiently well to produce a lithium complex and yields a good increase in the dropping point. In each case all of these esters are producing the same dilithium salts but whether or not the dilithium salt of terephthalic acid complexes with the lithium salt of 12-hydroxystearic acid is somehow tied to the reactivity of the diesters towards saponification.

It is interesting to note that a complex with the lithium salt of 12-hydroxystearic acid is not formed with the most reactive dialkyl terephthalic acid ester, i.e., the dimethyl ester of terephthalic acid (Sample A) whereas the other primary alcohol esters, i.e., the 2-ethylhexyl ester (Sample C]and diisobutyl ester (Sample D) esters of terephthalic acid being either branched or slightly less reactive are very efficient in forming lithium complexes.

Example 2: Preparation of Lithium Complex Thickened Grease According to the Invention With Diisooctyl Ester of Terephthalic Acid The dilithium salt of the diosooctyl ester of terephthalic acid has also been successfully utilized in the lithium complex thickeners and thickened greases of this invention (data not shown).

Example 3: Comparison of the Performance of Dilithium Salts of Dialkyl Esters of ortho, meta and para Benzene Dicarboxylic Acids Dilithium salts of dialkyl esters of phthalic acid, isophthalic acid and terephthalic acid are incorporated in the grease of the invention. Of the three possible benzene dicarboxylic acid diesters, phthalic acid (the ortho-substituted acid) and isophthalic acid (the meta-substituted acid) diesters produce lithium complex thickeners of inferior quality when compared with those obtained with terephthalic acid diesters (the para-substituted acids). The products obtained from phthalic acid and isophthalic acid diesters fail to produce homogeneous mixtures with lithium 12-hydroxystearate or esters thereof as indicated in Example 1.

Example 4: Comparison of the Performance of Dilithium Salts of Free Terephthalic Acid and Dialkyl Esters Thereof When incorporated in the grease of the invention free terephthalic acid produces a heterogeneous and nonreproducible product of inferior quality than that obtained with the dialkyl esters thereof, e.g., those utilized in Examples 1 and 2 above.

Example 5 Comparison of Formulated Lithium Complex Grease in Accordance with the Invention with a Commercially Available Product (Commercial Lithium Complex Grease-Pennzoil 707 Wheel Bearing Grease).

A formulation is prepared having the following ingredients listed in Table 2 hereinbelow.

TABLE 2

| Compositions of Formulated Lithium Complex Grease | |
|---|---|
| Component | Amount % |
| 12-Hydroxystearic acid | 10.27 |
| Dioctyl terephthalate | 2.23 |
| Lithium Hydroxide Monohydrate | 2.09 |
| Solvent 600 Neutral | 49.01 |
| 150 Bright Stock | 32.65 |
| Vanlube 73[1] | 3.00 |
| Vanlube AZ[2] | 0.25 |
| Vanlube 81[3] | 0.50 |

TABLE 2-continued

| Compositions of Formulated Lithium Complex Grease | |
|---|---|
| Component | Amount % |
| Total | 100.00 |

[1]Tradename of R.T. Vanderbilt Co. for antimony diamyldithiocarbamate.
[2]Tradename of R.T. Vanderbilt Co. for zinc diamyldithiocarbamate.
[3]Tradename of R.T. Vanderbilt Co. for p,p[1]-dioctyldiphenylamine.

A side-by-side comparison of the performance of the above formulation of the invention (Formulated Product) and a prior art grease (Commercial Lithium Complex grease) is provided below in Table 3.

TABLE 3

| Performance of Formulated Lithium Complex Grease (352–55) | | |
|---|---|---|
| Test Result | Formulated Product | Commercial Lithium Complex Grease |
| Penetration (60 stokes) (ADTM D217) | 288 | 275 |
| Penetration (10,000 stokes) | 310 | 297 |
| Penetration (% change) | 7.6 | 8.0 |
| Dropping Point (°F.) (ASTM D566) | 477 | 450 |
| 4-Ball Extreme Pressure Test (ASTM D2596) | 315 | 315 |
| 4-Ball Wear (mm) ASTM D2266 40 Kg, 1 hr, 75° C., 1200 rpm | 0.62 | 0.7 |
| Grease Life in Wheel Bearings (ASTM D 3527) Life at 150° C., av. hours | 190 | 150 |
| Water Washout (ASTM D1264) Mass % Loss @ 79° C. | 19.4 | 20.0 |

The invention now being fully described, it will be apparent to one of ordinary skill in the art that many changes and modifications can be made thereto without departing from the scope of the invention as set forth herein.

I claim:

1. A lithium complex grease thickener for increasing the dropping point of a lubricating grease, comprising as primary ingredients a lithium salt of a first compound selected from the group consisting of 12-hydroxystearic acid and ($C_1$–$C_{24}$) alkyl esters thereof; and a dilithium salt of a second compound consisting of di($C_1$–$C_{24}$) alkyl esters of terephthalic acid; the lithium salts of said first and second compounds being present in a molar proportion of about 0.5:1 to 15:1.

2. The grease thickener of claim 1, wherein the molar proportion of the lithium salts of said first compound to said second compound is about 1:1 to 10:1.

3. The grease thickener of claim 2, wherein the molar proportion of the lithium salts of said first compound and said second compound is about 2:1 to 6:1.

4. The grease thickener of claim 1, wherein the lithium salts of said first and second compounds are prepared by reacting a lithium base with said first and second compounds.

5. The grease thickener of claim 4, wherein the lithium base is reacted in an about molar proportion to the total amount of said first and second compounds.

6. The grease thickener of claim 1, wherein said second compound is selected from the group consisting of alkyl esters of di-2-ethylhexyl terephthalic acid, alkyl esters of diisobutyl terephthalic acid, alkyl esters of dimethyl terephthalic acid and alkyl esters of di-2-butyl terephthalic acid.

7. The grease thickener of claim 1, wherein the first compound is an alkyl ester of 12-hydroxystearic acid.

8. The grease thickener of claim 1, wherein the first compound is 12-hydroxystearic acid.

9. The grease thickener of claim 1 in homogeneous form.

10. A lithium complex thickened grease of high lubricating activity, shear stability, penetration and dropping point comprising a major proportion of a lubricating oil; and about 1 to 45 wt % of a lithium complex thickener with respect to the thickened grease; said thickener comprising a lithium salt of a first compound selected from the group consisting of 12-hydroxystearic acid and ($C_1$–$C_{24}$)alkyl esters thereof, and a dilithium salt of a second compound consisting of di($C_1$–$C_{24}$)alkyl esters of terephthalic acid; the lithium salts of said first and second compounds being present in a molar proportion of about 0.5:1 to 15:1.

11. The thickened grease of claim 10, wherein said lithium complex thickener is present in an amount of about 2 to 30 wt % with respect to the thickened grease.

12. The thickened grease of claim 10, wherein the lithium salt of said first compound is present in an amount of about 0.3 to 28 wt %; and the dilithium salt of said second compound is present in an amount of about 0.6 to 29 wt %, both with respect to the thickened grease.

13. The thickened grease of claim 12, wherein the lithium salt of said first compound is present in an amount of about 2 to 20 wt %; and the dilithium salt of said second compound is present in an amount of about 1 to 10 wt %, both with respect to the thickened grease.

14. The thickened grease of claim 10, exhibiting a dropping point higher than about 380° F.; and a shear stability corresponding to a softening of the grease between 60 and 10,000 strokes of less than about 15%.

15. A lithium complex thickened grease of high lubricating activity, shear stability, penetration and dropping points, comprising a lithium salt of a first compound selected from the group consisting of 12-hydroxystearic acid and ($C_1$–$C_{24}$)alkyl esters thereof;

a dilithium salt of a second compound consisting of di($C_1$–$C_{24}$)alkyl esters of terephthalic acid; the lithium salts of said first and second compounds being present in a molar proportion of about 0.5:1 to 15:1, and an additive selected from the group consisting of antioxidants or oxidation inhibitors, corrosion inhibitors, extreme pressure antiwear agents, fillers, tackiness agents, colorants and odor control agents.

16. The thickened grease of claim 15, wherein the antioxidant or oxidation inhibitor is selected from the group consisting of phenyl-alpha-naphthylamine, 2,2,4-trimethyldihydroquinoline oligomer, bis (alkylphenyl) amine,
phenothiazine and
N,N-diphenyl-p-phenylenediamine.

17. The thickened grease of claim 15, wherein the corrosion inhibitor is selected from a group consisting
mercaptobenzothiazole,
barium dinonylnaphthalene sulfonate,
glycerol monooleate,
sodium nitrite, and
imidazolines of tetraethylenepentamine.

18. The thickened grease of claim 15, wherein the extreme pressure antiwear agents are selected from a group consisting of
antimony, lead and zinc diorganophosphorodithioates,
phosphorus-sulfide treated olefins,
sulfurized olefins,
alkylphenate sulfides and disulfides,
tricresyl phosphate,
chlorinated paraffin waxes,
sulfurized glycerol trioleate, and
antimony, lead and zinc diamyldithiocarbamate.

19. A method of preparing a lithium complex thickened grease comprising contacting a lubricating oil and an about 1 to 45 wt % lithium complex thickener comprising as primary ingredients a lithium salt of a first compound selected from the group consisting of 12-hydroxystearic acid and ($C_1$–$C_{24}$) alky esters thereof, and a dilithium salt of a second compound consisting of di($C_1$–$C_{24}$) alkyl esters of terephthalic acid, the lithium salts of said first and second compounds in a molar proportion thereof of about 0.5:1 to 15:1 with a portion of said lubricating oil of up to about 70 wt % of the total amount of oil in the grease at a dissolving temperature;

adding a lithium base at said dissolving temperature in an about molar proportion to the sum of the amounts of said first and second compounds;

increasing the temperature to about 350° to 420° F.; and admixing thereto the remainder amount of said oil to obtain said thickened grease.

20. The method of claim 19, further comprising homogenizing said grease.

* * * * *